US011788015B2

(12) United States Patent
Kim et al.

(10) Patent No.: US 11,788,015 B2
(45) Date of Patent: Oct. 17, 2023

(54) METHOD OF PRODUCING SELECTIVE NAPHTHA OIL THROUGH SECONDARY PYROLYSIS OF WASTE OIL

(71) Applicants: SK Innovation Co., Ltd., Seoul (KR); SK Geo Centric Co., Ltd., Seoul (KR)

(72) Inventors: Ka Young Kim, Daejeon (KR); Do Kyoung Kim, Daejeon (KR); Hee Soo Kim, Daejeon (KR); Chang Q Lee, Daejeon (KR)

(73) Assignees: SK Innovation Co., Ltd., Seoul (KR); SK Geo Centric Co., Ltd., Seoul (KR)

( * ) Notice: Subject to any disclaimer, the term of this patent is extended or adjusted under 35 U.S.C. 154(b) by 0 days.

(21) Appl. No.: 17/336,708

(22) Filed: Jun. 2, 2021

(65) Prior Publication Data

US 2021/0380887 A1 Dec. 9, 2021

(30) Foreign Application Priority Data

Jun. 3, 2020 (KR) ..... 10-2020-0067117
Apr. 6, 2021 (KR) ..... 10-2021-0044765

(51) Int. Cl.
*C10G 1/10* (2006.01)
*C10G 1/00* (2006.01)
*C10G 11/05* (2006.01)

(52) U.S. Cl.
CPC ..... *C10G 1/10* (2013.01); *C10G 1/002* (2013.01); *C10G 11/05* (2013.01); *C10G 2300/1003* (2013.01)

(58) Field of Classification Search
CPC ..... C10G 1/10; C10G 1/002; C10G 11/05; C10G 2300/1003; C10G 11/00; C10G 11/02; C10G 11/04; C10G 55/04
See application file for complete search history.

(56) References Cited

U.S. PATENT DOCUMENTS

| | | | | |
|---|---|---|---|---|
| 6,193,780 | B1 | 2/2001 | Cases Rocati et al. | |
| 10,927,315 | B2 | 2/2021 | Ramamurthy et al. | |
| 2007/0098625 | A1 | 5/2007 | Adams et al. | |
| 2014/0121428 | A1* | 5/2014 | Wang | C10G 11/00 585/310 |
| 2019/0345393 | A1 | 11/2019 | Streiff et al. | |
| 2021/0130699 | A1* | 5/2021 | Bitting | B01J 6/008 |

FOREIGN PATENT DOCUMENTS

| | | | |
|---|---|---|---|
| EP | 0607994 | A1 | 7/1994 |
| JP | 2019534926 | A | 12/2019 |
| KR | 100311754 | B1 | 11/2001 |
| KR | 1020190092487 | A | 8/2019 |
| WO | 2015128033 | A1 | 9/2015 |
| WO | 2018055555 | A1 | 3/2018 |

* cited by examiner

*Primary Examiner* — Thuan D Dang
(74) *Attorney, Agent, or Firm* — THE WEBB LAW FIRM

(57) ABSTRACT

Provided is a method of producing naphtha from mixed plastic, the method including the following steps: (a) subjecting the mixed plastic to thermal pyrolysis; (b) separating a product produced in the thermal pyrolysis into first oil having a boiling point of lower than 150° C. and second oil having a boiling point higher than that of the first oil; and (c) subjecting the second oil to catalytic pyrolysis.

11 Claims, 1 Drawing Sheet

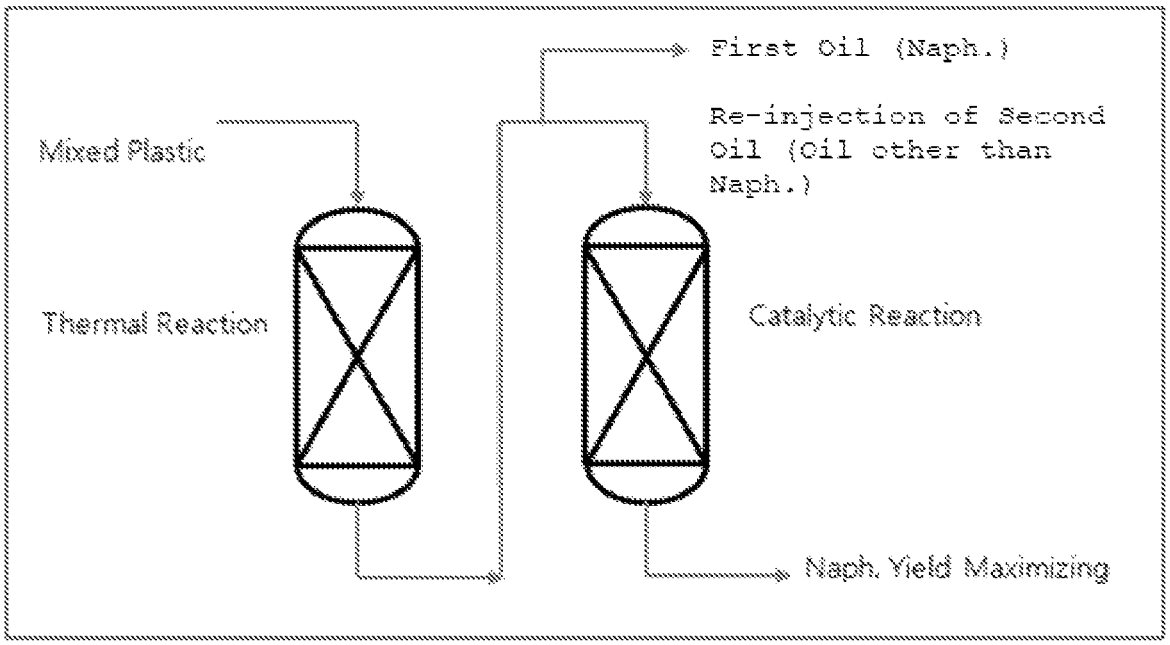
First Oil (Naph.)
Re-injection of Second Oil (Oil other than Naph.)
Mixed Plastic
Thermal Reaction
Catalytic Reaction
Naph. Yield Maximizing

METHOD OF PRODUCING SELECTIVE NAPHTHA OIL THROUGH SECONDARY PYROLYSIS OF WASTE OIL

CROSS-REFERENCE TO RELATED APPLICATIONS

This application claims priority to Korean Patent Application No. 10-2020-0067117 filed Jun. 3, 2020, and Korean Patent Application No. 10-2021-0044765 filed Apr. 6, 2021, the disclosures of which are hereby incorporated by reference in their entirety.

BACKGROUND OF THE INVENTION

Field of the Invention

The following disclosure relates to a method of producing selective naphtha oil through secondary pyrolysis of waste oil.

Description of Related Art

Various types of waste plastic pyrolysis oil having different boiling points such as naphtha (to 150° C.), kerosene (150 to 265° C.), light gas oil (LGO) (265 to 340° C.), and atmospheric residue (AR) (340° C.+) have been produced by cracking and pyrolysis reactions of waste materials such as waste plastic.

As a technology for maximizing a yield of light olefins according to the related art, a technology for increasing the value of waste plastic by introducing a fluid catalytic cracking (FCC) catalyst, ZSM-5 (additive), and the like into a single reactor has been reported.

However, in the technology according to the related art, it is difficult to secure cost-effectiveness through recycling of waste plastic. Thus, it is necessary to develop a technology for additionally increasing the value of waste plastic.

SUMMARY OF THE INVENTION

An embodiment of the present invention is directed to maximize a yield of naphtha through secondary pyrolysis (catalytic pyrolysis) of pyrolysis oil produced in primary pyrolysis (thermal pyrolysis).

Another embodiment of the present invention is directed to utilize an eco-friendly catalyst (an FCC waste catalyst or an FCC Equilibrium Catalyst (E. Cat.)) for existing pyrolysis oil at a relatively low temperature to maximize a yield of naphtha.

Still another embodiment of the present invention is directed to provide a technology for increasing the value of waste plastic by separating a specific component in primary pyrolysis oil in advance and selectively reacting unseparated heavy oil before secondary pyrolysis.

In one general aspect, a method of producing naphtha from mixed plastic includes: a step (a) of subjecting the mixed plastic to thermal pyrolysis; a step (b) of separating a product produced in the thermal pyrolysis into first oil having a boiling point of lower than 150° C. and second oil having a boiling point higher than that of the first oil; and a step (c) of subjecting the second oil to catalytic pyrolysis.

The method may further include a step (d) of separating third oil having a boiling point of lower than 150° C. by subjecting a product produced in the step (c) to fractional distillation and mixing the separated third oil with the first oil to produce final oil.

In the step (a), the mixed plastic may be subjected to thermal pyrolysis at a temperature of 500° or lower.

In the step (b), the first oil and the second oil may be separated in a weight ratio of 5:95 to 30:80.

A yield of naphtha in the first oil may be 5 to 30 wt % with respect to 100 wt % of pyrolysis oil obtained in the step (a).

The first oil and the second oil may satisfy the following Relational Expression 1:

$$1<A_1/A_2<5 \quad \text{[Relational Expression 1]}$$

wherein $A_1$ is a content (wt %) of Cl in the first oil and $A_2$ is a content (wt %) of Cl in the second oil.

The first oil and the second oil may satisfy the following Relational Expression 2:

$$1<B_1/B_2<1.5 \quad \text{[Relational Expression 2]}$$

wherein $B_1$ is a content (wt %) of olefins in the first oil and $B_2$ is a content (wt %) of olefins in the second oil.

Olefin components may be included in the second oil in an amount of 20 to 70 wt % with respect to a total weight of the second oil.

External olefin components may be included in the second oil in an amount of 5 to 40 wt % with respect to the total weight of the second oil.

A catalyst used in the step (c) may be zeolite, clay, silica-alumina-phosphate (SAPO), aluminum phosphate (ALPO), metal organic framework (MOF), silica alumina, or a mixture thereof.

A yield of naphtha in the third oil may be 10 to 50 wt % with respect to 100 wt % of pyrolysis oil obtained in the step (a).

In the step (c), the second oil may be subjected to catalytic pyrolysis at a temperature of 500° or lower.

A yield of naphtha in the produced final oil may be 35 wt % or more with respect to 100 wt % of pyrolysis oil obtained in the step (a).

Other features and aspects will be apparent from the following detailed description, the drawings, and the claims.

BRIEF DESCRIPTION OF THE DRAWING

FIG. 1 is a schematic view illustrating a method of producing naphtha from mixed plastic according to an exemplary embodiment of the present invention.

DESCRIPTION OF THE INVENTION

Unless defined otherwise, all terms (including technical and scientific terms) used in the present specification have the same meanings as commonly understood by those skilled in the art which the present invention pertains. Throughout the present specification, unless explicitly described to the contrary, "comprising" any components will be understood to imply further inclusion of other components rather than the exclusion of any other components. In addition, the singular forms are intended to include the plural forms as well, unless the context clearly indicates otherwise.

In the present specification, the description "A to B" means "A or more and B or less", unless defined otherwise.

In addition, the description "A and/or B" means at least one selected from the group consisting of A and B, unless defined otherwise.

In the present specification, a boiling point (bp) of each of first oil and second oil is measured at atmospheric pressure (1 atm), unless defined otherwise.

An exemplary embodiment of the present invention relates to a method of producing naphtha from mixed plastic, and the method includes: a step (a) of subjecting the mixed plastic to thermal pyrolysis; a step (b) of separating a product produced in the thermal pyrolysis into first oil having a boiling point of lower than 150° C. and second oil having a boiling point higher than that of the first oil; and a step (c) of subjecting the second oil to catalytic pyrolysis.

An object of the present invention is to produce naphtha by subjecting primary pyrolysis oil obtained from mixed plastic to secondary pyrolysis (catalytic pyrolysis). In the production of naphtha oil, a naphtha component in the primary pyrolysis oil is separated in advance and only unseparated heavy oil is selectively subjected to a catalytic reaction to maximize a yield of the naphtha.

The step (a) is a step of subjecting the mixed plastic to thermal pyrolysis. In the step (a), the mixed plastic is converted into a hydrocarbon product in a thermal pyrolysis unit.

The mixed plastic includes waste rubber and/or waste plastic. Specifically, the mixed plastic may include polyethylene (PE), polypropylene (PP), polyvinyl chloride (PVC), polystyrene (PS), and the like.

The hydrocarbon product includes waste rubber and/or waste plastic pyrolysis oil. Biomass pyrolysis oil, recycled lubricating oil, high chlorine-containing crude oil, or a mixture thereof may be further mixed, if necessary.

The thermal pyrolysis is designed from a thermal pyrolysis method using a batch reactor, for example, a rotary kiln type batch reactor. After the mixed plastic is uniformly melted, primary pyrolysis may be performed, but the present invention is not limited thereto. Meanwhile, the thermal pyrolysis may not particularly include a pretreatment step and an additive injection step that are performed to remove impurities or the like.

The thermal pyrolysis may be performed at a temperature of 500° C. or lower and preferably 300 to 500° C., 350 to 400° C., or 400 to 450° C. and a pressure of 0 bar(g) or more and 3 bar(g) or less and preferably 0 bar(g) or more and 0.3 bar(g) or less, but the present invention is not limited thereto.

The thermal pyrolysis may be performed for 30 minutes to 16 hours and preferably 5 hours to 12 hours, but the present invention is not limited thereto.

In a case where the thermal pyrolysis is performed under the above temperature, pressure, and/or time condition, heavy oil in which a content of olefins is high may be produced, and heavy oil in which a concentration of external olefins is high may also be produced.

The step (b) is a step of separating a product produced in the thermal pyrolysis into first oil having a boiling point of lower than 150° C. and second oil having a boiling point higher than that of the first oil. In the step (b), primary pyrolysis oil is separated into a naphtha component (first oil) and unseparated heavy oil (second oil) before secondary pyrolysis (catalytic pyrolysis).

The pyrolysis oil produced from the mixed plastic may be separated into oil having a specific boiling point through a general fractional distillation method, but the present invention is not limited thereto.

The boiling point of the first oil is lower than 150° C., may be, for example, 120 to lower than 150° C., and may vary depending on properties of synthetic plastic pyrolysis oil. Specifically, the step (b) may be a step of separating a product produced in the thermal pyrolysis into first oil having a boiling point of lower than 140° C. and second oil having a boiling point higher than that of the first oil.

The second oil is unseparated heavy oil remaining after the first oil is separated. The boiling point of the second oil exceeds the boiling point of the first oil. In the present invention, the naphtha component in the pyrolysis oil obtained from the mixed plastic is separated in advance and only the remaining unseparated heavy oil is selectively subjected to the secondary pyrolysis (catalytic pyrolysis), thereby significantly increasing a yield of final naphtha. In catalytic pyrolysis of waste plastic pyrolysis oil according to the related art, there is a problem in that a high content of Cl is generated due to light naphtha fraction. On the contrary, in the present invention, the first oil of the naphtha component is separated and the remaining unseparated heavy oil is subjected to catalytic pyrolysis, such that a high content of naphtha may be produced, and also, problems such as corrosion in a reactor and a loss of a product in a secondary pyrolysis (catalytic pyrolysis) process may be solved.

Meanwhile, the boiling point of each of the first oil and the second oil may be an average boiling point, and an error range thereof may be ±10° C.

The first oil and the second oil are preferably separated in a weight ratio of 5:95 to 30:80 and may be separated in a weight ratio of 10:90 to 30:70. In the above weight ratio range, a heavy component in the second oil is relatively increased to reduce production of oil vapor and increase production of naphtha in the catalytic pyrolysis in the step (c).

A yield of naphtha in the first oil may be 5 to 30 wt %, 10 to 30 wt %, 20 to 30 wt %, or 20 to 25 wt %, with respect to 100 wt % of the pyrolysis oil obtained in the step (a). Therefore, the effects described above may be further increased.

The first oil and the second oil may satisfy the following Relational Expression 1.

$$1<A_1/A_2<5 \quad \text{[Relational Expression 1]}$$

wherein $A_1$ is a content (wt %) of Cl in the first oil and $A_2$ is a content (wt %) of Cl in the second oil.

Relational Expression 1 may satisfy $1<A_1/A_2<4$, $1<A_1/A_2<3.5$, or $1<A_1/A_2<3$.

The first oil and the second oil may satisfy the following Relational Expression 2.

$$1<B_1/B_2<1.5 \quad \text{[Relational Expression 2]}$$

wherein $B_1$ is a content (wt %) of olefins in the first oil and $B_2$ is a content (wt %) of olefins in the second oil.

Relational Expression 2 may satisfy $1<B_1/B_2<1.4$, $1<B_1/B_2<1.3$, $1<B_1/B_2<1.2$, or $1<B_1/B_2<1.1$.

It is a common phenomenon that the content of the olefins that are light components in the first oil is high; however, in the present invention, the content of the olefins in the second oil is adjusted to a level similar to that in the first oil. Therefore, the oil in which the content of the olefins is high is subjected to catalytic pyrolysis, such that the yield of the naphtha may be increased. Meanwhile, in a case where catalytic pyrolysis is performed in the step (c), recombination of organic Cl occurs through combination of Cl with the olefins in the second oil, which causes a loss of a product. However, in the present invention, the content of Cl in the second oil with respect to the content of Cl in the first oil is low, the loss of the product is significantly small and the production of oil vapor is reduced even when the content of the olefins is high. Therefore, the production of the naphtha may be significantly increased. In addition, Cl is primarily removed by separating the first oil in which the content of Cl is high from the viewpoint of corrosion of a subsequent catalytic pyrolysis reactor, such that chloride stress corrosion cracking (Cl—SCC) may be prevented.

The olefin components in the second oil may be 20 to 70 wt % with respect to a total weight of the second oil, and specifically, may be 30 to 70 wt %, 30 to 60 wt %, or 30 to 50 wt %, with respect to the total weight of the second oil. In a case where the content of the olefins is within the above range at the time of the catalytic pyrolysis of the pyrolysis oil, the production of oil vapor is suppressed and the yield of the naphtha is increased.

The external olefin components in the second oil may be 5 to 40 wt % with respect to the total weight of the second oil, and specifically, may be 10 to 40 wt %, 10 to 30 wt %, or 15 to 30 wt %, with respect to the total weight of the second oil. In a case where catalytic pyrolysis is performed in the step (c), recombination of organic Cl occurs through combination of the external olefins with Cl rather than the internal olefins in the oil, which causes a loss of a product. However, in the present invention, although the content of the external olefins in the second oil is high, the content of Cl is low. Thus, the loss of the product is significantly low, and the production of oil vapor is reduced. Therefore, the production of the naphtha may be significantly increased.

The step (c) is a step of subjecting the second oil to catalytic pyrolysis and a step of converting the second oil into naphtha in a catalytic pyrolysis unit. In the step (c), only unseparated heavy oil may be selectively subjected to catalytic pyrolysis to improve the yield of the naphtha.

In the catalytic pyrolysis, the second oil may be injected into the catalytic pyrolysis unit, and the second oil may be subjected to catalytic pyrolysis at a temperature of 500° C. or lower and preferably 450 to 500° C. and atmospheric pressure in a $N_2$ atmosphere for 1 to 30 minutes and preferably 1 to 10 minutes or 1 to 2 minutes. The yield of the naphtha may be increased under the above catalytic pyrolysis conditions.

Zeolite, clay, silica-alumina-phosphate (SAPO), aluminum phosphate (ALPO), metal organic framework (MOF), silica alumina, or a mixture thereof may be used as a catalyst. Waste zeolite, waste clay, or the like obtained in a petrochemical process may be used as it is or may used through a simple treatment to additionally improve activity.

Meanwhile, for example, a fluidized bed catalyst is used in a residue fluidized catalytic cracking (RFCC) process in which residues are converted into light/middle distillate. In order to keep the entire activity in the RFCC process constant, a certain amount of catalyst in operation is replaced with a fresh catalyst, and the replaced catalyst at this time is referred to as an RFCC equilibrium catalyst (E-Cat) and the entire amount thereof is treated as waste. The RFCC E-Cat may be used as the catalyst of the present invention and may contain 30 to 50 wt % of zeolite, 40 to 60 wt % of clay, and 0 to 30 wt % of other materials (alumina gel, silica gel, functional material, and the like). By using such an RFCC E-Cat as the catalyst, a difference in cracking activity is small in comparison to the fresh catalyst and there are advantages such as environmental protection and cost reduction through recycling.

A simple treatment may be required to use the waste zeolite, the waste clay, and the like as the catalyst in the process of the present invention. When an active site of the catalyst is physically blocked by materials such as coke and oil, the catalyst may be used after the materials are removed therefrom. Air burning may be performed to remove coke, and a treatment with a solvent may be performed to remove oil. In a case where a metal component affects the active site of a solid acid material to deactivate the active site, if necessary, a DeMet process for removing a metal component by subjecting weak acid or dilute hydrogen peroxide to medium-temperature treatment may be applied.

Meanwhile, the catalyst may further include a carrier or binder including carbon, alkaline earth metal oxide, alkali metal oxide, alumina, silica, silica-alumina, zirconia, titania, silicon carbide, niobia, aluminum phosphate, or a mixture thereof.

The second oil may be included in an amount of 40 to 80 parts by weight, preferably 40 to 60 parts by weight, and more preferably 40 to 50 parts by weight, with respect to 100 parts by weight of the catalyst. The catalytic pyrolysis effect is improved as the amount of catalyst materials introduced is increased within the above range, and when the amount of the second oil is 40 parts by weight or more, the production of oil vapor may be suppressed due to an excessive reaction, which is preferable.

Meanwhile, a weight ratio of the catalyst to the second oil (Cat/oil ratio) may be 1 to 3, 1 to 2.8, 1 to 2.6, 1 to 2.5, or 1.2 to 2.4.

The catalytic pyrolysis may be performed under a known reactor operation condition for the second oil from which the naphtha component is separated by using a fluidized bed reactor, for example, a catalytic pyrolysis method using a semi-fluidized bed reactor, but the present invention is not limited thereto.

The method of producing naphtha from mixed plastic according to an exemplary embodiment of the present invention may further include a step (d) of separating third oil having a boiling point of lower than 150° C. by subjecting a product produced in the step (c) to fractional distillation and mixing the separated third oil with the first oil to produce final oil. Meanwhile, the boiling point of the third oil may be the same as that of the first oil, and in this case, an error range thereof may be ±10° C.

A yield of naphtha in the produced final oil may be 35 wt % or more, 40 wt % or more, 45 wt % or more, 50 wt % or more, 51 wt % or more, or 52 wt % or more, with respect to 100 wt % of the pyrolysis oil obtained in the step (a). An upper limit of the yield is not particularly limited, but may be 90 wt % or less or 85 wt % or less. Naphtha oil may be produced in a high yield by a technology for additionally increasing the value of waste plastic according to the present invention, and cost-effectiveness may be secured through recycling of waste plastic.

Hereinafter, preferred examples and comparative examples of the present invention will be described. However, each of the following examples is merely a preferred exemplary embodiment of the present invention, and the present invention is not limited to the following examples.

EXAMPLES

Example 1

(a) Primary pyrolysis oil was produced by subjecting waste mixed plastic (PE, PP, and PS) to thermal pyrolysis in a rotary kiln type reactor. Fuel was fed through a lower portion of the kiln and heating was performed by burning the fuel so that the temperature inside the kiln was 350 to 400° C. A part of oil vapor decomposed through the heating was used for heating the kiln, and the remaining pyrolysis oil was cooled and condensed and stored in a primary storage tank. The pyrolysis oil in the primary storage tank was centrifuged to remove solid contents, thereby producing primary pyrolysis oil.

(b) The produced primary pyrolysis oil was separated into first oil having a boiling point of lower than 150° C. and second oil having a boiling point of higher than 150° C. by a general fractional distillation method.

(c) The second oil remaining after the naphtha component (first oil) was separated was injected into a semi-fluidized bed reactor in which a catalyst was loaded and catalytic pyrolysis was performed. (Feed injection rate: 1 cc/min, Cat/oil ratio: 2.4, temperature: 500° C.)

In this case, an RFCC E-Cat (containing 40 wt % of zeolite, wt % of clay, and 10 wt % of other materials (silica gel, alumina gel, and functional material), average particle size: 80 μm) was used as a catalyst. As the RFCC E-Cat, a catalyst obtained after being used as a cracking catalyst in an RFCC process (RFCC Cat) and then discarded was used as it was.

(d) The produced catalytic pyrolysis product was separated into oil having a boiling point of lower than 150° C. and oil having a boiling point of higher than 150° C. by a general fractional distillation method, and then, the oil was mixed with the naphtha oil (first oil) separated in the step (b), thereby producing final naphtha oil.

Comparative Example 1

Comparative Example 1 was performed in the same manner as that of Example 1, except that the step (b) in Example 1 was not performed and the primary pyrolysis oil obtained in the step (a) was added to a semi-fluidized bed reactor in the step (c).

Evaluation Examples

[Evaluation Example 1]: Evaluation of Yield of Naphtha

The results of treating waste mixed plastic in Example 1 and Comparative Example 1 are shown in Table 1.

TABLE 1

| | bp (° C.) | Example 1 | Comparative Example 1 |
|---|---|---|---|
| 1st Naph. | IBP to 150 | 23.9 | — |
| 2nd Naph. | IBP to 150 | 28.6 | — |
| Total Naph. | IBP to 150 | 52.5 | 34.3 |
| Off gas | C1 and C2 boiling points | 0.7 | 1.8 |
| LPG | C3 and C4 boiling points | 27.6 | 30.1 |
| Kero | 150 to 265 | 10.9 | 19.3 |
| LGO | 265 to 340 | 2.8 | 7.6 |
| AR | 340+ | 1.8 | 6.8 |

(In Table 1, 1st Naph and 2nd Naph are expressed as wt % of naphtha produced in the step (b) and the step (c), respectively, with respect to 100 wt % of the primary pyrolysis oil, and Total Naph is expressed as a yield (%) of the final naphtha produced in the step (d), the yield (%) of the final naphtha being obtained by summing 1st Naph and 2nd Naph.)

Referring to Table 1, it could be confirmed that in the case of Example 1, only the unseparated heavy oil remaining after the naphtha component in the primary pyrolysis oil was separated in advance was selectively subjected to secondary pyrolysis, such that the yield of the final naphtha was increased. On the other hand, it was analyzed that in the case of Comparative Example 1, since the remaining oil except for gas components in the pyrolysis oil produced in the primary pyrolysis (thermal pyrolysis) was used as feed in the secondary pyrolysis (catalytic pyrolysis), the naphtha component included in the primary pyrolysis oil was converted into gas components through the secondary pyrolysis, and thus, the yield of the final naphtha was reduced.

In addition, it could be confirmed that in the case of Example 1, the heavy component in the second oil used as feed in catalytic pyrolysis was relatively increased to reduce production of oil vapor (Off gas and C1 and C2) during the catalytic pyrolysis by 41% compared to Comparative Example 1.

[Evaluation Example 2] Analysis of Properties of Pyrolysis Oil

Example 2

(a) Primary pyrolysis oil was produced by performing a thermal pyrolysis step including reactive distillation and a hydrogenation reaction step using a reactor having a two-stage reaction section. As reaction conditions, the thermal pyrolysis step including reactive distillation was performed at a temperature of 500° C. or lower and preferably 360 to 450° C., and the hydrogenation reaction step was performed. The primary pyrolysis oil produced through the reactive distillation has a relatively small amount of external olefins.

(b) The produced primary pyrolysis oil was separated into first oil having a boiling point of lower than 150° C. and second oil having a boiling point of higher than 150° C. by a general fractional distillation method.

(c) and (d) were performed in the same manner as those of Example 1.

The content of olefins, the content of external olefins, and the content of Cl among the properties of the pyrolysis oil obtained in (a) of each of Examples 1 and 2 are shown in Table 2. In addition, the content (wt %) of naphtha produced by catalytic pyrolysis in (c) is shown in Table 3.

TABLE 2

| | Properties of first oil | | | Properties of second oil | | |
|---|---|---|---|---|---|---|
| | Content of olefins (wt %) | Content of external olefins (wt %) | Content of Cl (ppm) | Content of olefins (wt %) | Content of external olefins (wt %) | Content of Cl (ppm) |
| Example 1 | 47.9 | 22.3 | 255 | 44.1 | 25.5 | 87 |
| Example 2 | 23.8 | 11.2 | 24.5 | 24.5 | 10.6 | 24.0 |

TABLE 3

| | Yield of naphtha (wt %) in catalytic pyrolysis product obtained in (c) |
|---|---|
| Example 1 | 37.6 |
| Example 2 | 32.7 |

(In Table 3, the yield of naphtha is expressed as wt % of catalytic pyrolysis product naphtha obtained in (c) with respect to 100 wt % of the primary pyrolysis oil obtained in (a).)

Referring to Table 2, it could be confirmed that in the cases of Examples 1 and 2, the properties of the first and second oil were within the range of Relational Expression 1 of the present invention. In particular, referring to Table 3, it could be confirmed that in the case of Example 1, the properties of first and second oil were within the preferred range of Relational Expression 2, which showed that the yield of the naphtha during the catalytic pyrolysis was significantly increased.

Naphtha oil may be produced in a high yield by a technology for additionally increasing the value of waste plastic according to the present invention, and cost-effectiveness may be secured through recycling of waste plastic.

Hereinabove, although exemplary embodiments of the present invention have been described, the present invention is not limited to the exemplary embodiments, and may be made in various forms different from each other. It will be understood by those skilled in the art that the present invention may be implemented in another specific form without departing from the technical spirit and essential features of the present invention. Therefore, it is to be understood that exemplary embodiments described hereinabove are illustrative rather than being restrictive in all aspects.

What is claimed is:

1. A method of producing naphtha from mixed plastic, comprising the following steps:

(a) subjecting the mixed plastic to thermal pyrolysis and thereby producing a primary pyrolysis oil;

(b) separating the primary pyrolysis oil produced in the thermal pyrolysis into first oil having a boiling point of lower than 150° C. and comprising naphtha, and second oil having a boiling point higher than that of the first oil by fractional distillation;

(c) subjecting only the second oil to catalytic pyrolysis and thereby producing a catalytic pyrolysis product; and (d) separating third oil having a boiling point of lower than 150° C. and comprising naphtha by subjecting the catalytic pyrolysis product produced in the step (c) to fractional distillation and mixing the separated third oil with the first oil to produce final oil comprising naphtha, wherein the first oil and the second oil satisfy the following Relational Expression 1:

$$1<A_1/A_2<5 \quad \text{Relational Expression 11}$$

wherein $A_1$ is a content (wt %) of Cl in the first oil and $A_2$ is a content (wt %) of Cl in the second oil.

2. The method of claim 1, wherein in step (a), the mixed plastic is subjected to thermal pyrolysis at a temperature of 500° C. or lower.

3. The method of claim 1, wherein in step (b), the first oil and the second oil are separated in a weight ratio of 5:95 to 30:80.

4. The method of claim 1, wherein a yield of naphtha in the first oil is 5 to 30 wt % with respect to 100 wt % of pyrolysis oil obtained in step (a).

5. The method of claim 1, wherein the first oil and the second oil satisfy the following Relational Expression 2:

$$1<B1/B2<1.5 \quad \text{[Relational Expression 2]}$$

wherein B1 is a content (wt %) of olefins in the first oil and B2 is a content (wt %) of olefins in the second oil.

6. The method of claim 1, wherein olefin components are included in the second oil in an amount of 20 to 70 wt % with respect to a total weight of the second oil.

7. The method of claim 6, wherein external olefin components are included in the second oil in an amount of 5 to 40 wt % with respect to the total weight of the second oil.

8. The method of claim 1, wherein a catalyst used in step (c) is zeolite, clay, silica-alumina-phosphate (SAPO), aluminum phosphate (ALPO), metal organic framework (MOF), silica alumina, or a mixture thereof.

9. The method of claim 1, wherein a yield of naphtha in the third oil is 10 to 50 wt % with respect to 100 wt % of pyrolysis oil obtained in step (a).

10. The method of claim 1, wherein in step (c), the second oil is subjected to catalytic pyrolysis at a temperature of 500° C. or lower.

11. The method of claim 1, wherein a yield of naphtha in the produced final oil is 35 wt % or more with respect to 100 wt % of pyrolysis oil obtained in step (a).

* * * * *